US007121024B1

(12) United States Patent
Clevenberg

(10) Patent No.: US 7,121,024 B1
(45) Date of Patent: Oct. 17, 2006

(54) CREASER STEAM IRON

(76) Inventor: Suzanne T Clevenberg, 42 Hudson Point La., Ossining, NY (US) 18562-5942

( * ) Notice: Subject to any disclaimer, the term of this patent is extended or adjusted under 35 U.S.C. 154(b) by 0 days.

(21) Appl. No.: 11/252,050

(22) Filed: Oct. 17, 2005

(51) Int. Cl.
*D06F 71/28* (2006.01)
*D06F 75/00* (2006.01)

(52) U.S. Cl. ..... 38/71; 38/25

(58) Field of Classification Search ..... 38/12, 38/14, 70, 71, 88, 77.1, 25, 69; 219/245
See application file for complete search history.

(56) References Cited

U.S. PATENT DOCUMENTS

| | | | | |
|---|---|---|---|---|
| 1,950,498 | A * | 3/1934 | Lehnen et al. | 38/71 |
| 2,748,511 | A | 6/1956 | Pezza | |
| 2,763,075 | A | 9/1956 | Vance | |
| 2,849,736 | A | 9/1958 | Kohle | |
| 3,068,598 | A * | 12/1962 | Johnston | 38/71 |
| 3,423,966 | A | 1/1969 | Mitchell | |
| 3,577,859 | A * | 5/1971 | Davidson | 38/71 |
| 3,690,024 | A | 9/1972 | Osrow | |
| 3,703,042 | A | 11/1972 | Smith | |
| 3,706,146 | A | 12/1972 | Anderson | |
| 3,742,629 | A | 7/1973 | Plasko | |
| 3,790,043 | A | 2/1974 | Hegen | |
| 3,793,753 | A | 2/1974 | Engelbart | |
| 3,811,208 | A | 5/1974 | Vieceli et al. | |
| 3,997,759 | A | 12/1976 | Osrow et al. | |
| 4,206,340 | A | 6/1980 | Osrow et al. | |
| 4,219,724 | A * | 8/1980 | Allvin | 219/243 |
| 4,571,483 | A | 2/1986 | Fathi | |
| 4,815,441 | A | 3/1989 | Schawbel et al. | |
| 4,817,309 | A | 4/1989 | Frank et al. | |
| 4,845,868 | A * | 7/1989 | Tierney et al. | 38/71 |
| D319,121 | S | 8/1991 | Muller | |
| 5,123,266 | A | 6/1992 | Tabraham | |
| 5,299,372 | A * | 4/1994 | Kelly et al. | 38/36 |
| 5,341,541 | A | 8/1994 | Sham | |
| 5,420,961 | A | 5/1995 | Walker | |
| D376,232 | S | 12/1996 | Villar | |
| 5,609,047 | A | 3/1997 | Hellman, Jr. et al. | |
| 5,651,201 | A | 7/1997 | Farley | |
| D388,576 | S | 12/1997 | Gudefin et al. | |
| 6,032,391 | A | 3/2000 | Yao | |
| 6,112,367 | A | 9/2000 | Burr et al. | |
| 6,191,387 | B1 | 2/2001 | Smal | |
| D445,540 | S | 7/2001 | Hirata | |
| D467,051 | S | 12/2002 | Marbury | |
| 6,857,209 | B1 * | 2/2005 | Wehrwein et al. | 38/77.1 |
| 2003/0070331 | A1 | 4/2003 | Chen | |
| 2005/0028408 | A1 | 2/2005 | Tobias et al. | |

FOREIGN PATENT DOCUMENTS

| | | |
|---|---|---|
| WO | WO96/24233 | 8/1996 |

* cited by examiner

*Primary Examiner*—Ismael Izaguirre
(74) *Attorney, Agent, or Firm*—Michael I. Kroll

(57) ABSTRACT

An apparatus for changing a characteristic of fabric comprising a first member and a second member pivotally connected to said first member wherein at least one of the first and the second member are able to be heated and to provide heat to a plurality of types of fabrics. When a respective fabric is positioned between the first and second member and the heatable means contacts a surface of the fabric and changes a condition of the fabric.

5 Claims, 11 Drawing Sheets

CREASER STEAM IRON

BACKGROUND OF THE INVENTION

1. Field of the Invention

The present invention relates generally to irons and, more specifically, to a portable iron that does not require the use of an ironing board. A dual iron device includes two hingedly attached members where at least one member provides heat to iron fabric. The members are hard flat surfaces to replace the need for an ironing board. Additionally the members pivot about the hinge so that they are in the same plane wherein the device can be used to steam fabric.

2. Description of the Prior Art

There are other heating device designed for ironing. Typical of these is U.S. Pat. No. 2,748,511 issued to Pezza on Jun. 5, 1956.

Another patent was issued to Vance, et al. on Sep. 18, 1956 as U.S. Pat. No. 2,763,075. Yet another U.S. Pat. No. 2,849,736 was issued to Kohle on Sep. 2, 1958 and still yet another was issued on Jan. 28, 1969 to Mitchell as U.S. Pat. No. 3,423,966.

Another patent was issued to Osrow on Sep. 12, 1972 as U.S. Pat. No. 3,690,024. Yet another U.S. Pat. No. 3,703,042 was issued to Smith on Nov. 21, 1972 Another was issued to Anderson on Dec. 19, 1972 as U.S. Pat. No. 3,706,146 and still yet another was issued on Jul. 3, 1973 to Plasko as U.S. Pat. No. 3,742,629.

Another patent was issued to Hagen on Feb. 5, 1974 as U.S. Pat. No. 3,790,043. Yet another U.S. Pat. No. 3,793,753 was issued to Engelbart on Feb. 26, 1974. Another was issued to Vieceli, et al. on May 21, 1974 as U.S. Pat. No. 3,811,208 and still yet another was issued on Dec. 14, 1976 to Osrow, et al. as U.S. Pat. No. 3,997,759.

Another patent was issued to Osrow, et al. on Jun. 3, 1980 as U.S. Pat. No. 4,206,340. Yet another U.S. Pat. No. 4,571,483 was issued to Fathi on Feb. 18, 1986. Another was issued to Schawbel, et al. on Mar. 28, 1989 as U.S. Pat. No. 4,815,441 and still yet another was issued on Apr. 4, 1989 to Frank as U.S. Pat. No. 4,817,309.

Another patent was issued to Tabraham on Jun. 23, 1992 as U.S. Pat. No. 5,123,266. Yet another U.S. Pat. No. 5,341,541 was issued to Sham on Aug. 30, 1994. Another was issued to Walker on May 30, 1995 as U.S. Pat. No. 5,420,961 and still yet another was issued on Mar. 11, 1997 to Hellman, Jr., et al. as U.S. Pat. No. 5,609,047.

Another patent was issued to Farley on Jul. 29, 1997 as U.S. Pat. No. 5,651,201. Yet another U.S. Pat. No. 6,032,391 was issued to Yao on Mar. 7, 2000. Another was issued to Burr, et al. on Sep. 5, 2000 as U.S. Pat. No. 6,112,367 and still yet another was issued on Feb. 20, 2001 to Smal as U.S. Pat. No. 6,191,387.

Another patent was issued to Muller on Aug. 13, 1991 as U.S. Patent No. Des. 319,121. Yet another U.S. Patent No. Des. 376,232 was issued to Villar on Dec. 3, 1996. Another was issued to Gudefin, et al. on Dec. 30, 1997 as U.S. Patent No. Des. 388,576 and still yet another was issued on Jul. 24, 2001 to Hirata as U.S. Patent No. D445,540.

Another patent was issued to Marbury on Dec. 10, 2002 as U.S. Patent No. D467,051. Yet another U.S. Patent Application No. 2003/0070331 was issued to Chen on Apr. 17, 2003. Another was issued to Tobias on Feb. 10, 2005 as U.S. Patent Application No. 2005/0028408 and still yet another was issued on Aug. 8, 1996 to Galliou as International Patent Application No. WO 96/24233.

U.S. Pat. No. 2,748,511

Inventor: Mariana Pezza

Issued: Jun. 5, 1956

A garment presser for forming creases in and smoothing surfaces of articles of clothing; said presser comprising a pair of jaws, each jaw including a blade having a compartment therein and a handle extending from an end of the blade in parallelism with the handle of the other jaw; a pivot member connecting said handles together; resilient means acting on said handles to urge the jaws to move to swing the blades toward each other; heating means comprising conducting elements arranged one in said compartment of each blade; one of said blades being adapted to overlie the other and having a second compartment arranged to underlie the first mentioned compartment in said blade and having an opening in one edge wall of the blade; a pair of flat panel elements confronting each other, one of said panel elements having therein a set of perforations spaced apart all over said panel according to a predetermined pattern, said one panel forming a wall portion of the second compartment of said one blade, the other panel element forming a wall portion of the compartment in the other of said blades; a container for liquids having a wall slidably contacting the perforated panel and having a set of perforations registerable with the perforations of the first mentioned set, said container having a filling neck, provided with a movable closure, and projecting through the opening in said one edge of said one blade; a spring reacting against said one edge to slide the container to bring the perforations therein out of register with the perforations of the first mentioned set; a plunger projecting through a wall of the second compartment of said one blade into engagement with said container; and means operable by movement of the handles to move the plunger and cause the perforations in the container to register with the perforations of the first set.

U.S. Pat. No. 2,763,075

Inventor: John E. Vance, et al.

Issued: Sep. 18, 1956

An electric iron comprising, a sole plate, heating means therefor, said sole plate being formed with a boiler chamber to convert water into stream, a handle pivotally mounted on said sole plate on a horizontal axis and normally occupying a vertically extending position, a water reservoir formed in said handle, said handle including a conduit for conducting water from said reservoir to said boiler, and valve means operative to cut of the flow of water from the reservoir to said boiler when said handle is moved from its normal vertical position.

U.S. Pat. No. 2,849,736

Inventor: Albert G. Kohle

Issued: Sep. 2, 1958

A self-contained steam generating brush comprising an elongated housing having a chamber at its forward end and a rearwardly extending hollow hand grip portion, a steam generating boiler in said chamber, a liquid containing reservoir mounted within the hand grip portion of said housing, said steam generating boiler having an electrically energized heating unit for converting a jet of water into steam, circuit connections for said electrical unit carried by said hand grip portion and extending therefrom for connection to a source of electric power, a thumb operated pump mounted within said handle portion and associated with said fluid containing tank to project a jet of water from said tank upon the electrically energized heating unit of said steam generating boiler, whereby upon each operation of said pump a quantity of water will impinge upon said heating unit and steam will be flash generated in said boiler, a fabric engaging brush at the forward end of said housing, and a steam directing nozzle extending from said steam generating boiler and terminating at said brush.

U.S. Pat. No. 3,423,966

Inventor: Margaret S. Mitchell

Issued: Jan. 28, 1969

An apparatus for steaming fabric 48 materials comprising:

a longitudinally extending shell, said shell having a semicircular face and plurality of orifices longitudinally placed on said semicircular face, said orifices being sufficiently large to allow water to pass therethrough into the shell; a porous heat resistant material located within the shell and able to absorb a substantial amount of water; a handle attached to said shell said handle comprising a leg attached to one end of the shell and having an axis perpendicular to the axis of the shell, and an arm extending from the other end of the leg and having an axis perpendicular to the leg and parallel to the shell; a flat electrical heating element contacting on one side of the heating element, the outside flattened face of the shell; insulation on the other side of the flat heating element; electrical conducting means for supplying electrical power to the flat electrical heating element; and a temperature responsive electrical switching means mounted within the shell for interrupting electrical current between the electrical conducting means and the electrical heating element at a preset temperature.

U.S. Pat. No. 3,690,024

Inventor: Leonard Osrow

Issued: Sep. 12, 1972

A lightweight portable electric hand steamer with a special sole plate having a prow that is uniquely shaped to spread the concealed short edges at the rear of a seam joining two plies of fabric which are to be pressed into planarity. The prow includes a leading beak for initiating separation of the short rear edges. Behind the prow the sole plate is provided with a flat pressing surface. Steam issues through the pressing surface to impinge upon the fabric plies being pressed as well as upon the short rear edges so as to render them pliant for pressing. The entire sole plate, but particularly the flat pressing surface, is formed of a synthetic plastic whereby the pressing surface has a low specific heat and a low coefficient of heat conductivity so that the pressing surface is relatively cool in comparison with a conventional metal pressing surface. This has the unusual effect of preventing the outline of the steamed-flat short rear edges from showing' through the planar portions of the plies after the pressing/steaming operation has been completed.

U.S. Pat. No. 3,703,042

Inventor: Sally J. Smith

Issued: Nov. 21, 1972

A one-piece pump bellows of a flexible, resilient material with a corrugated generally cylindrical sidewall having a plurality of interleaved outer and inner bends with interconnecting wall portions. The corrugated wall is not of uniform thickness and the thickness at the bends of the wall is greater than the maximum thickness of the interconnecting wall portions. The thickness of the interconnecting wall portions immediately adjacent the bends is less than the maximum thickness of the interconnecting wall portions. The outer bends have associated pairs of opposed circumferential ribs on the inside surface of the interconnecting walls and the inner bends have associated pairs of opposed circumferential ribs on the outside surface of the interconnecting walls. The pairs of opposed ribs are adapted to abut when the bellows is foreshortened by overstroking which decreases the maximum stress to which the bends are subjected and substantially increases the service life of the bellows.

U.S. Pat. No. 3,706,146

Inventor: Arvid B. Anderson

Issued: Dec. 19, 1972

An electrically heated steam and vacuum hand iron. A vacuum port is provided at the periphery of the soleplate of the iron and outwardly of the steam discharge apertures in the soleplate to extract steam and moisture from the pressed fabric, more quickly to dry the pressed fabric, thereby to speed hand ironing operations.

U.S. Pat. No. 3,742,629

Inventor: Emil Robert Plasko

Issued: Jul. 3, 1973

A portable hand-held electric clothes steamer has a one-piece body or housing with an integral fill opening intermediate a water chamber and a combined steam chamber and water trap, the position of the water inlet opening defining the maximum water level. Electric neon indicators are provided for showing when the unit is plugged in and also for showing when the unit has run dry. Provision is made for use of the steamer, in one embodiment, in either domestic or European current.

U.S. Pat. No. 3,790,043

Inventor: Elmer Ray Hagen

Issued: Feb. 5, 1974

Structure for attachment to slacks, or other such garments, tending to remove wrinkles and restore creases by exerting forces on the slacks both transverse and parallel to the creases. The transverse force is exerted by attaching the structure to the slacks at the front and rear at points aligned with the creases in the area between the waistband and crotch and maintaining a stretching force. The longitudinal force is provided by suspending the slacks freely from the cuffs with the structure attached, whereby the weight of the structure exerts a longitudinal force along the cuffs. The structure comprises a pair of telescoping rods with spring clips at the remote ends and detent means for maintaining the desired spacing of the clips to exert the transverse stretching force on the slacks.

U.S. Pat. No. 3,793,753

Inventor: Wilhelm Engelbart

Issued: Feb. 26, 1974

A manually operated steam ironing device comprises a bottom portion including a bottom ironing plate having outlet openings to allow passage of steam. An upper portion includes a hand receiving means located above the ironing plate. The hand receiving means has a structural configuration effective to enwrap at least a portion of an operator's hand for protecting the operator's hand and to facilitate operation of the device. The upper portion also includes a padded insulated layer and a carrier plate portion having a structural configuration which defines an insulating chamber above the bottom heating plate. The bottom portion includes a heating element and a heated cover plate carrying said element. The cover plate has a structural configuration to form a steam expansion chamber between itself and the bottom ironing plate.

U.S. Pat. No. 3,811,208

Inventor: Joseph L. Vieceli, et al.

Issued: May 21, 1974

An electric pressing iron adapted for operation in a horizontal plane for pressing fabrics or usable in. a vertical plane to steam hanging clothes, drapes and the like: The iron includes a small compact soleplate above which is superimposed an all plastic reservoir and handle assembly having the handle extending outwardly from the reservoir and a housing portion positioned between the reservoir and the soleplate enclosing a thermostat and a temperature control arm. The means for delivering' water from the 'reservoir to a steam chamber on the upper surface of the soleplate comprises a compact pump having a diaphragm which is operable by direct finger pressure to deliver water from the reservoir to the steam chamber. The pump which is mounted in an opening for the reservoir is removable to permit the pouring of water into the reservoir. The reservoir and handle include a one piece injection molded plastic member which includes a downwardly facing cup-shaped portion which is closed by the housing member to form the reservoir. The pump permits the iron to be operated in any position while delivering substantial quantities of steam from the orifices disposed in the soleplate.

U.S. Pat. No. 3,997,759

Inventor: Leonard Osrow, et al.

Issued: Dec. 14, 1976

A device for applying steam to the exposed surface of previously applied wallpaper so as to cause the same to penetrate the wallpaper and loosen the adhesive bond between the wallpaper and the underlying substrate. The device is a compact steamer for vertical surfaces which is composed of a forward steam plenum chamber and a rear water chamber having a common separating wall between them. The steam plenum chamber has a steam discharge opening in its front wall. Associated with the common wall is a steam passageway that is wholly contained within the steamer. The steam passageway leads from a steam entry port near the top of the water chamber to a steam discharge port in the steam plenum chamber. To heat the water in the water chamber to steaming temperature, a pair of mutually spaced electrodes is disposed in and near the bottom of the water chamber and is supplied with power through a manually operable switch. A cap selectively closes a fill-opening in the water chamber. The cap and switch are provided with an interlock which prevents opening of the fill-cap when the switch energizes the electrodes and which prevents the switch from being moved to actuated position unless the fill-cap is closed.

U.S. Pat. No. 4,206,340

Inventor: Leonard Osrow, et al.

Issued: Jun. 3, 1980

A steaming device for pressing and ironing fabric includes a hollow body and a sole plate having a pointed prow. A pair of passages lead from an electrolytically heated steam generator within the body to the front portion of the sole plate. The first passage is permanently open and leads to a plurality of first openings in a linear pattern generally aligned with the longitudinal axis of the prow. The second passage leads to steam openings in the sole plate which latter openings extend transversely across the width of the sole plate rearwardly of first openings. The second passage is larger than the first and has more steam openings associated with it so that steam will flow through it more readily than through the first. A plug is associated with the top of the second passage. The plug can be moved from a position in which the passage is unblocked to a position in which the passage is blocked. The electrolytically heated steam generator includes three electrodes disposed in a quantity of electrolytic solution provided within a reservoir within the body. The spacing between a first and a second electrode is greater than the spacing between the second and third electrodes so that steam generation rate may be controlled by an appropriate adjustable electric switch, with steam generation being at a higher rate when an electrical potential is impressed between the second and third electrodes than when the electrical potential is impressed between the first and second electrodes.

U.S. Pat. No. 4,571,483

Inventor: Saul S. Fathi

Issued: Feb. 18, 1986

This portable steamer device has a central cylindrical casing open at opposite ends. A handle is rotatably mounted to a cylindrical cap attached to the rear end of the casing. A baffle is mounted to the front end of the casing, and has holes for emitting steam. In the casing is a heater assembly to heat water in a first chamber conically shaped body with a central aperature closes the chamber but permits water to pass into the chamber and steam to pass out of the chamber. A tube section inside a second chamber between the baffle and the body which passes steam to the baffle while any water which may inadvertently spill out of the first chamber is captured in the second chamber, thus, water cannot leak out of the device.

U.S. Pat. No. 4,815,441

Inventor: William Schawbel, et al.

Issued: Mar. 28, 1989

A portable curling iron having a barrel to be heated, includes first and second burners which heat the barrel; a fuel supply cartridge which supplies fuel to the first and second burners, the cartridge including a fuel delivery valve which controls the flow of fuel from the cartridge; a plunger which applies a force to the valve in response to user actuation, to start the flow of fuel from the cartridge; a regulator assembly including a diaphragm which applies a reverse force to the plunger when the gas pressure exceeds a predetermined pressure, to maintain a substantially constant flow rate of fuel to the first and second burners; a valve stem through which the fuel travels from the cartridge to the second burner; a bimetallic element for applying a force to the valve stem to permit the fuel to pass to the second burner when the temperature is less than a predetermined start-up temperature and for removing such force when the predetermined start-up temperature is attained; and a spring which applies a reverse force to the valve stem to prevent the fuel to pass to the second burner when the predetermined start-up temperature is attained, so as to achieve fast heat up of the barrel without fuel waste.

U.S. Pat. No. 4,817,309

Inventor: Karlheinz Frank

Issued: Apr. 4, 1989

A hand-held steam brush, consisting of a support plate with steam holes which forms an outer wall of the hand-held steam brush. A pressure plate with steam exit holes is releasably secured to the support plate. The pressure plate, guided by hinged spacers, is movable towards the support plate counter to the pressure of a spring and can be fixedly connected to the support plate by means of a pressure plate locking device.

U.S. Pat. No. 5,123,266

Inventor: David Tabraham

Issued: Jun. 23, 1992

A clothes steamer which can be secured to a wall such as the wall of a hotel room, the steamer including a housing with a heating element in it. The element boils water which is in the housing and causes a flow of steam along a flexible hose to a nozzle. An audible warning device is provided for indicating that an adequate supply of steam is being generated.

U.S. Pat. No. 5,341,541

Inventor: John C. K. Sham

Issued: Aug. 30, 1994

A portable hand-held steam vacuum cleaner is provided which includes a housing having a handle portion and a nozzle portion. A reservoir is defined in the housing for retaining cleaning solution or water, and a heating unit is associated with the reservoir for heating the liquid so as to generate steam for delivery to a surface to be cleaned. A motor driven fan assembly is disposed within the housing in communication with the nozzle portion for drawing excess liquid and debris into the nozzle portion. The nozzle portion defines structure for separating and containing the liquid which is drawn into the vacuum cleaner.

U.S. Pat. No. 5,420,961

Inventor: Cedric T. M. Walker

Issued: May 30, 1005

A steaming device includes a reservoir for containing a predetermined quantity of water, a heater for heating the water and producing the steam, a nozzle for exhausting out the steam, a conduit for connecting the nozzle with the reservoir, and an external support structure for supporting components of steaming device. The nozzle make up part of a programmable automatic flow adjusting system for selectively varying the direction and speed of the steam flowing out therefrom.

U.S. Pat. No. 5,609,047

Inventor: Robert R. Hellman, Jr., et al.

Issued: Mar. 11, 1997

A portable garment steaming device for use in the home which emits steam through a retractable nozzle plate of a safety nozzle assembly which when retracted prevents against accidental touching of the hot nozzle plate. The garment steaming device also includes a clothes hanger assembly for hanging the article of clothing to be steamed. A water bottle compartment for supplying water to be generated as steam for the safety nozzle assembly is further provided which is detachably mounted for refilling.

U.S. Pat. No. 5,651,201

Inventor: Brent Lee Farley

Issued: Jul. 29, 1997

An iron having a mitt component and a heating element subdivided into at least two portions. A pivot interconnects the at least two portions of the heating element. A reservoir system interconnects a fluid tank to the heating element to enable the iron to possess steam generating capabilities. The mitt is preferably attached to the heating element by an annular crimping portion. The mitt further includes a pocket for receiving the hand of a user.

U.S. Pat. No. 6,032,391

Inventor: Isoji Yao

Issued: Mar. 7, 2000

An iron having an iron main body and an electromagnetic valve which controls flow and stop of ironing steam. The iron is provided with a first tube for ironing steam, which sends ironing steam to the iron main body in open state of the electromagnetic valve, a second tube for heating steam, which sends heating steam to its end side along the first tube and heats approximately whole length of the first tube, and a third tube, which returns the steam from the end side of the second tube.

U.S. Pat. No. 6,112,367

Inventor: Jean-Marc Burr, et al.

Issued: Sep. 5, 2000

The appliance comprises a portable and electrical self-contained assembly comprising a case of plastics material defining a housing in which there are disposed an instant steam generator operating at atmospheric pressure with a porous water storage body and electrical heater resistance elements, and a steam distributor for diffusing steam through a series of front orifices. The case is extended by a squeegee carrier fitted with a squeegee blade projecting from the front of the appliance.

U.S. Pat. No. 6,191,387

Inventor: Henri Smal

Issued: Feb. 20, 2001

Hairdressing tongs have a pair of arms extending from handles. Each arm has a heating pad affixed thereto. The handles have opposed openings. A central element is positioned between the handles and fitted within the openings such that the central element is slidable toward the handles. The central element has guide openings. Springs are positioned in the guide openings for biasing apart the handles. The springs enable hand pressure to move the handles and arms together from a completely open position to a completely closed position and, in absence of the hand pressure, to maintain the handles and arms in relatively parallel configuration, biased against stops of the central element.

U.S. Patent Number Des. 319,121

Inventor: Ronald L. Muller

Issued: Aug. 13, 1991

The ornamental design for a garment steamer, as shown in the patent drawings.

U.S. Patent Number Des. 376,232

Inventor: Albert Villar

Issued: Dec. 3, 1996

The ornamental design for a gas heated seaming iron, as shown in the patent drawings.

U.S. Patent Number Des. 388,576

Inventor: Jacques Gudefin, et al.

Issued: Dec. 30, 1997

The ornamental design for a combined iron and steam generator, as shown in the patent drawings.

U.S. Patent Number D445,540

Inventor: Yoshihiro Hirata

Issued: Jul. 24, 2001

The ornamental design for a hair iron, as shown in the patent drawings.

U.S. Patent Number D467,051

Inventor: Yvonne L. Marbury

Issued: Dec. 10, 2002

The ornamental design for a battery operated iron, as shown in the patent drawings.

U.S. Patent Application Number 2003/0070331

Inventor: Shou Mao Chen

Published: Apr. 17, 2003

An ironing structure comprises a shell and a blow drier detachably attached to the shell. The shell is provided in the top with a receiving portion for holding one end of the barrel of the blow drier. The receiving portion is in communication with the hollow interior of the shell. The shell is provided at the bottom with a soleplate which is warmed up by the hot air streams of the blow drier to facilitate the pressing of the clothes.

U.S. Patent Application Number 2005/0028408

Inventor: Andrew J. Tobias

Published: Feb. 10, 2005

A hand-held, convertible pressing iron/steamer device includes a steaming module including a compartment for holding water, and a heater for producing steam from the water. The device further includes an ironing module including a heatable flat pressing bottom surface, the ironing module being selectively attachable to the steaming module so as to direct steam through the flat pressing bottom surface. There is also a handle attachable to the steaming module and the ironing module. In a first configuration, the handle is operably and detachably mounted to the steaming module alone. In a second configuration, the handle is operably and detachably mounted to the steaming module and the ironing module.

International Patent Application Number WO 96/24233

Inventor: Henri Galliou

Published: Aug. 8, 1996

A method for assembling an electrical heating assembly including at least one diffusing plate (1) and at least one heating element (4) arranged in contact therewith. The heating elements (4) are arranged in contact with the diffusing plate (1) and the assembly is subjected to hot heading. The resulting electrical heating assembly produced according to the method is also disclosed.

SUMMARY OF THE PRESENT INVENTION

The present invention relates generally to irons and, more specifically, to a portable iron that does not require the use of an ironing board. A dual iron device includes two hingedly attached members where at least one member provides heat to iron fabric. The members are hard flat surfaces to replace the need for an ironing board. Additionally the members pivot about the hinge so that they are in the same plane wherein the device can be used to steam fabric.

A primary object of the present invention is to provide a dual iron device that overcomes the shortcomings of the prior art.

Another, secondary object of the present invention is to provide a dual iron device that will iron and steam fabric without the use of an ironing board.

Another object of the present invention is to provide a dual iron device whereby an article of clothing is pressed while hanging.

Yet another object of the present invention is to provide a dual iron device that is portable.

Another object of the present invention is to provide a dual iron device having two members that are hingedly connected to one another.

Yet another object of the present invention is to provide a dual iron device whereby tension exists between the two members.

Still another object of the present invention is to provide a dual iron device whereby a heating mechanism heats at least one of the members.

Yet still another object of the present invention is to provide a dual iron device whereby the outside of each member is made from a heat resistant material to prevent the user from being burned.

Another object of the present invention is to provide a dual iron device whereby one of the members act in lieu of an ironing board.

Yet still another object of the present invention is to provide a dual iron device whereby the at least one heated member applies heat to fabric.

Still yet another object of the present invention is to provide a dual iron device whereby the two members clamp together to engage an article to be pressed.

Yet another object of the present invention is to provide a dual iron device whereby the at least one heated member includes a plurality of apertures allowing steam to escape.

Another object of the present invention is to provide a dual iron device whereby one member is flipped out providing a single steaming iron engaging surface.

Yet another object of the present invention is to provide a dual iron device that is simple and easy to use.

Still yet another object of the present invention is to provide a dual iron device that is inexpensive to manufacture and operate.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
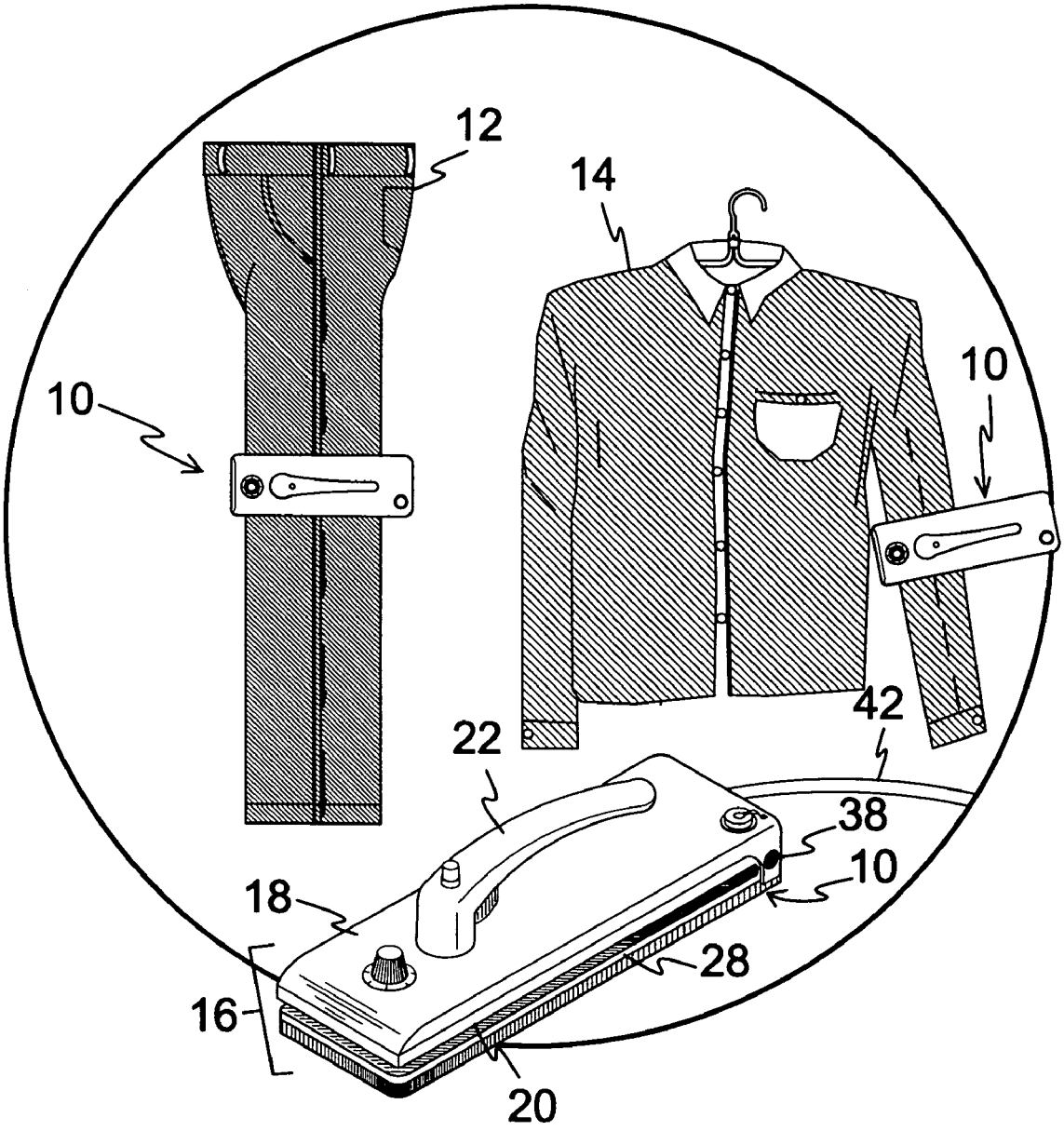
FIG. 1 is an illustrative view of the dual iron device of the present invention in use.

Turning now descriptively to the drawings, in which similar reference characters denote similar elements throughout the several views, the Figures illustrate the dual iron device of the present invention. With regard to the reference numerals used, the following numbering is used throughout the various drawing Figures.

| | |
|---|---|
| 10 | Dual iron device of the present invention |
| 12 | pants |
| 14 | Shirt |
| 15 | Shirt sleeve |

-continued

| | |
|---|---|
| 16 | housing |
| 18 | first member of housing |
| 20 | second member of housing |
| 22 | handle |
| 24 | steam button |
| 26 | heat adjustment knob |
| 28 | first heat plate |
| 30 | second heat plate |
| 32 | steam ports |
| 34 | open/close clamping trigger |
| 36 | knuckle pad |
| 38 | hinge |
| 40 | water tank |
| 42 | electrical cord |
| 44 | down directional arrows |
| 46 | crease |
| 48 | fabric |
| 50 | top side first member |
| 52 | bottom side first member |
| 54 | water tank aperture |
| 56 | power source |
| 58 | second member top |
| 60 | second member bottom |
| 62 | heating mechanism |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 11 illustrate a dual iron device of the present invention which is indicated generally by the reference numeral 10.

FIG. 1 is an illustrative view of the dual iron device 10 of the present invention in use. The dual iron device 10 includes a housing 16 having a first member 18 and a second member 20. In the present embodiment, only the first member 18 has a first heat plate 28 to provide heat. However, in an alternate embodiment both the first member 18 and the second member 20 include the first heat plate 28 and a second heat plate 30 respectively. The first member 18 is attached to the second member 20 via a hinge 38 at a first end of each thereof. The hinge 38 creates a tension such that the first member 18 is caused to be parallel to the second member 20 having a predetermined distance therebetween. Each member is rectangular in shape. However, this is for purposes of example only, and each member may be formed of any geometric shape.

Figure 2:
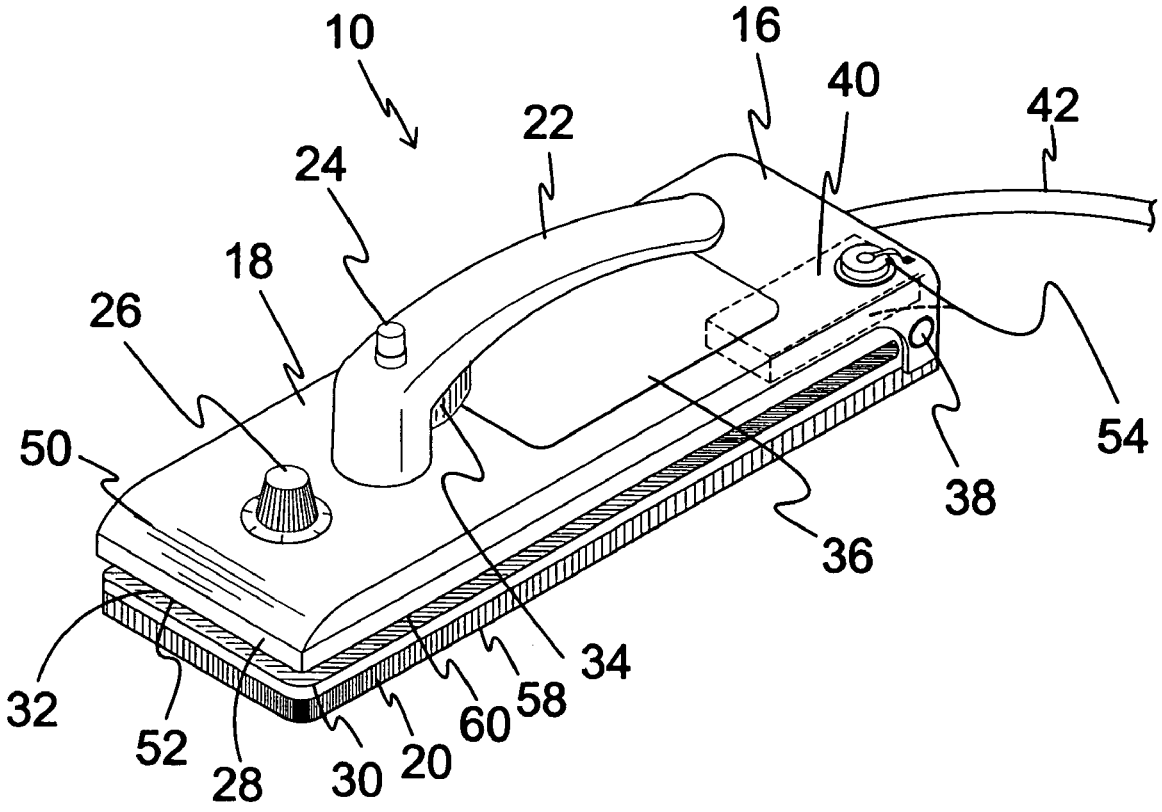
FIG. 2 is a perspective view of the dual iron device of the present invention.

Shown herein, the dual iron device 10 is being used to iron a pair of pants 12 and a shirt 14. Both the pants 12 and the shirt 14 are able to be ironed while hanging, without the use of an ironing board. The pants 12 are placed between the first 18 and second 20 member of the housing 16. An open/close clamping trigger 34, as will be discussed hereinafter with specific reference to FIG. 2, is used to press the first 18 and second 20 members against the pants 12. The dual iron device 10 is then moved along the length of the pants 12 while heat presses the pants.

The dual iron device 10 of the present invention is advantageous in that it facilitates the ironing of fabric 48. The second 20 member of housing 16 provides support for the fabric 48 typically provided by an ironing board. The dual iron device 10 also provides for an easier method of ironing creases into fabric 48. In one embodiment both the first 18 and second 20 member provide heat thereby enabling both sides of a fabric 48 to be ironed at the same time, decreasing ironing time. The dual iron device 10 provides for the tension between the first 18 and second 20 members, created by the hinge 38, to be released thereby allowing the first 18 and second 20 members of the housing 16 to be opened along a horizontal plane to iron in a traditional manner.

FIG. 2 is a perspective view of the dual iron device 10 of the present invention. The dual iron device 10 includes the housing 16 having the first member 18 and the second member 20. The first member 18 is attached to the second member 20 via the hinge 38 at one end. The hinge 38 creates a tension such that the first member 18 is parallel to the second member 20. Each member is rectangular in shape.

The first member 18 includes a top side 50 and a bottom side 52. The bottom side 52 includes the first heat plate 28 positioned thereon. The second member 20 includes a top side 58 and a bottom side 60 and the bottom side 60 faces the first heat plate 28. The housing 16 includes a heating mechanism 62 for heating the first heat plate 28. The first heat plate 28 includes a plurality of steam ports 32 to selectively release steam onto the fabric 48. The top side 50 is made of a heat resistant material to prevent the user from being burned from the heat emitted by the first heat plate 28. A handle 22 is attached to the top side 50. The handle 22 is centered above the top side 50 in order to maximize the ease of using the device 10. A knuckle pad 36 is located below the handle 22 on the top side 50. The knuckle pad 36 provides a cushion for the user's knuckles as this is where the knuckles rest when the user grips the handle 22. A heat adjustment knob 26 is located on the top side 50 between the handle 22 and the edge opposing the hinged edge of the top side 50. The heat adjustment knob 26 controls the heating mechanism 62 to determine an amount of heat to apply to the first heat plate 28.

When the first member 18 is parallel to the second member 20 of the housing 16, the bottom 60 of the second member 20 is located between the bottom side 52 of the first member 18 and the top side 58 of the second member 20. The bottom 60 of the second member 20 is a hard flat surface that acts as an ironing board. In an alternative embodiment, the bottom 60 of the second member 20 is covered with the second heat plate 30. In this alternate embodiment, both sides of the fabric 48 are ironed simultaneously thereby decreasing the ironing time. Additionally, this embodiment requires the top 58 of the second member 20 to be formed from a heat resistant material to prevent burning the user.

The handle 22 includes a steam button 24 located thereon for steaming fabric 48 when depressed. When the steam button 24 is depressed, steam is released through the steam ports 32 on the first heat plate 28. The underside of the handle 22 includes an open/close clamping trigger 34. When the open/close clamping trigger 34 is activated, both the first 18 and second 20 members clamp the fabric 48 therebetween to iron the fabirc. However, the clamping is not so tight as to prevent moving the dual iron device 10 along the fabric 48 while the open/close clamping trigger 34 is activated.

A water tank 40 is located within the first member 18 of the housing 16. The water tank 40 is filled with water through a water tank aperture 54 positioned on the top side 50 of the first member 18. A plurality of devices can be used to cover the water tank aperture 54 including but not limited to a cap and a one-way valve thereby preventing the water in the tank 40 from leaking. The water is heated by the power source 56 and when the steam button 24 is depressed, the water is converted to steam and exits the dual iron device 10 through the steam ports 32.

Figure 3:
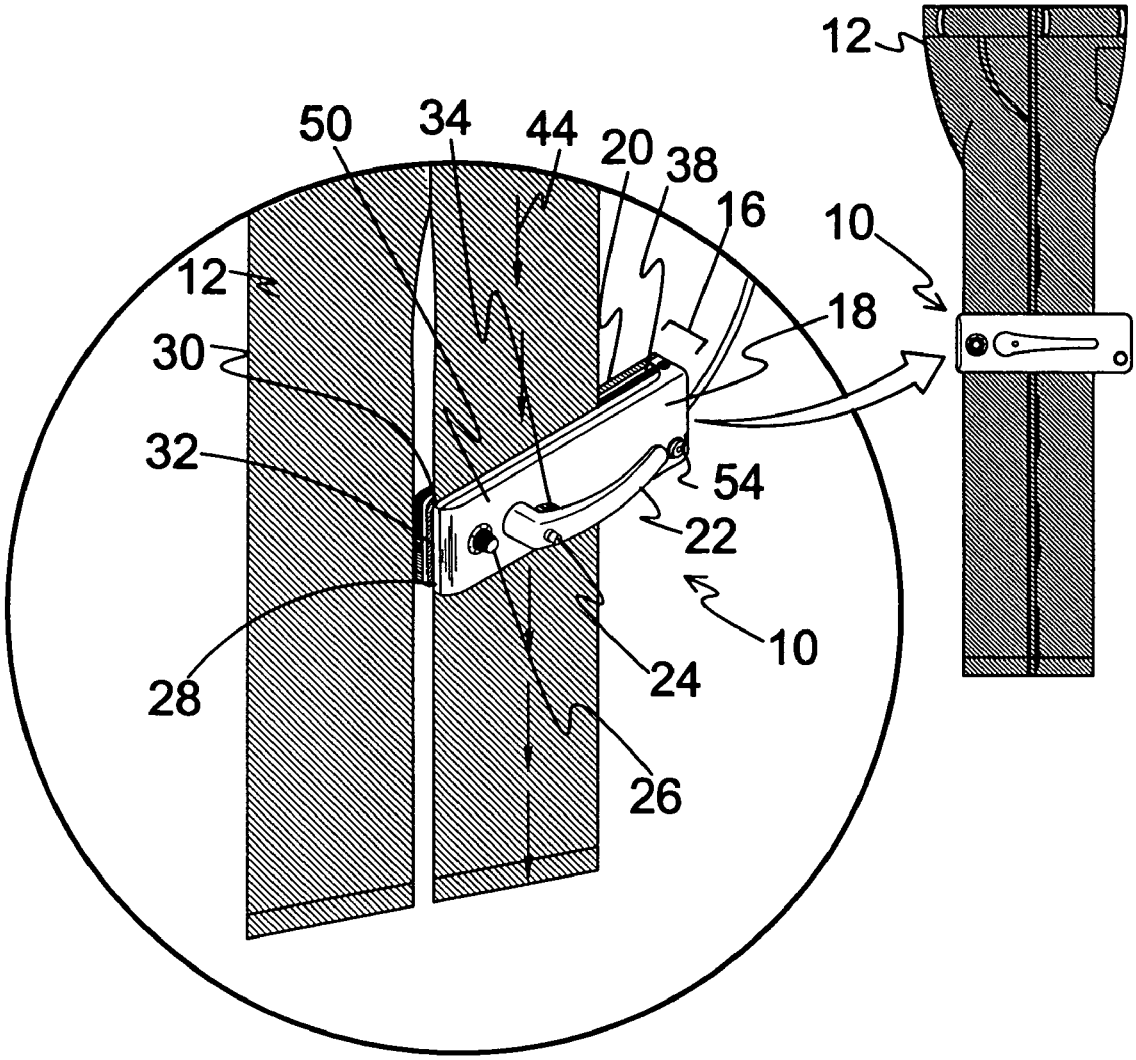
FIG. 3 is an illustrative view of the dual iron device of the present invention in use.

FIG. 3 is an illustrative view of the dual iron device 10 of the present claimed invention. The dual iron device 10 includes the housing 16 having the first member 18 and the second member 20. The first member 18 is attached to the second member 20 via the hinge 38 at one end. The hinge 38 creates a tension such that the first member 18 is parallel to the second member 20. Each member is rectangular in shape.

The first member 18 includes the top side 50 and the bottom side 52. The bottom side includes the first heat plate 28 positioned along the bottom side 52. The second member 20 includes the top side 58 and the bottom side 60 and the bottom side 60 faces the first heat plate 28. The housing 16 includes the heating mechanism 62 for heating the first heat plate 28. The first heat plate 28 includes the plurality of steam ports 32 to selectively release steam onto the fabric 48. The handle 22 is attached to the top side 50. The length of the handle 22 is centered above the top side 50 in order to maximize the ease of using the device 10. The knuckle pad 36, providing a cushion for the user's knuckles, is located below the handle 22 on the top side 50, as shown in FIG. 2. The heat adjustment knob 26 is located on the top side 50 between the handle 22 and the edge opposing the hinged edge of the top side 50. The heat adjustment knob 26 controls the heating mechanism 62 to determine an amount of heat to apply to the first heat plate 28. The heat for the heat mechanism 62 is supplied by a plurality of means including but not limited to an electrical cord 42 and a battery.

When the first member 18 is parallel to the second member 20 of the housing 16, the bottom 60 of the second member 20 is located between the bottom side 52 of the first member 18 and the top side 58 of the second member 20. The bottom 60 of the second member 20 is a hard flat surface that acts as an ironing board. In an alternative embodiment, the bottom 60 of the second member 20 is covered with the second heat plate 30. In this alternate embodiment, both sides of the fabric 48 are ironed simultaneously thereby decreasing the ironing time. The top 58 of the second member 20 is made of a heat resistant material to prevent burning the user.

The steam button 24 is located on the handle 22 and when depressed, is used to steam fabric 48. The open/close clamping trigger 34 is located on the underside of the handle 22. When the open/close clamping trigger 34 is activated, both the first 18 and second 20 members clamp the fabric 48 between them to iron it. However, the clamping is not so tight as to prevent moving the dual iron device 10 along the fabric 48 while the open/close clamping trigger 34 is activated.

Shown herein, the dual iron device 10 is being used to iron the pair of pants 12. The pants 12 are being ironed while hanging, without the use of an ironing board. The pants 12 are placed between the first 18 and second 20 member of the housing 16. The open/close clamping trigger 34 is activated to press the first 18 and second 20 members against the pants 12. The dual iron device 10 is then moved along the length of the pants 12 in a downward direction as indicated by the downward directional arrows 44 while heat presses the pants. In the present embodiment, only the first member 18 has the first heat plate 28 to provide heat. The dual iron device 10 creates a crease in the pants 12 due to the way the pants 12 are folded when the dual iron device 10 is applied.

The dual iron device 10 of the present invention is advantageous in that it can be portable. Additionally, the dual iron device 10 can be battery operated so there is no need for an electrical outlet. The dual iron device 10 is also advantageous in that there is no need for the assistance of an ironing board as the second member 20 provides a hard flat surface.

Figure 4:
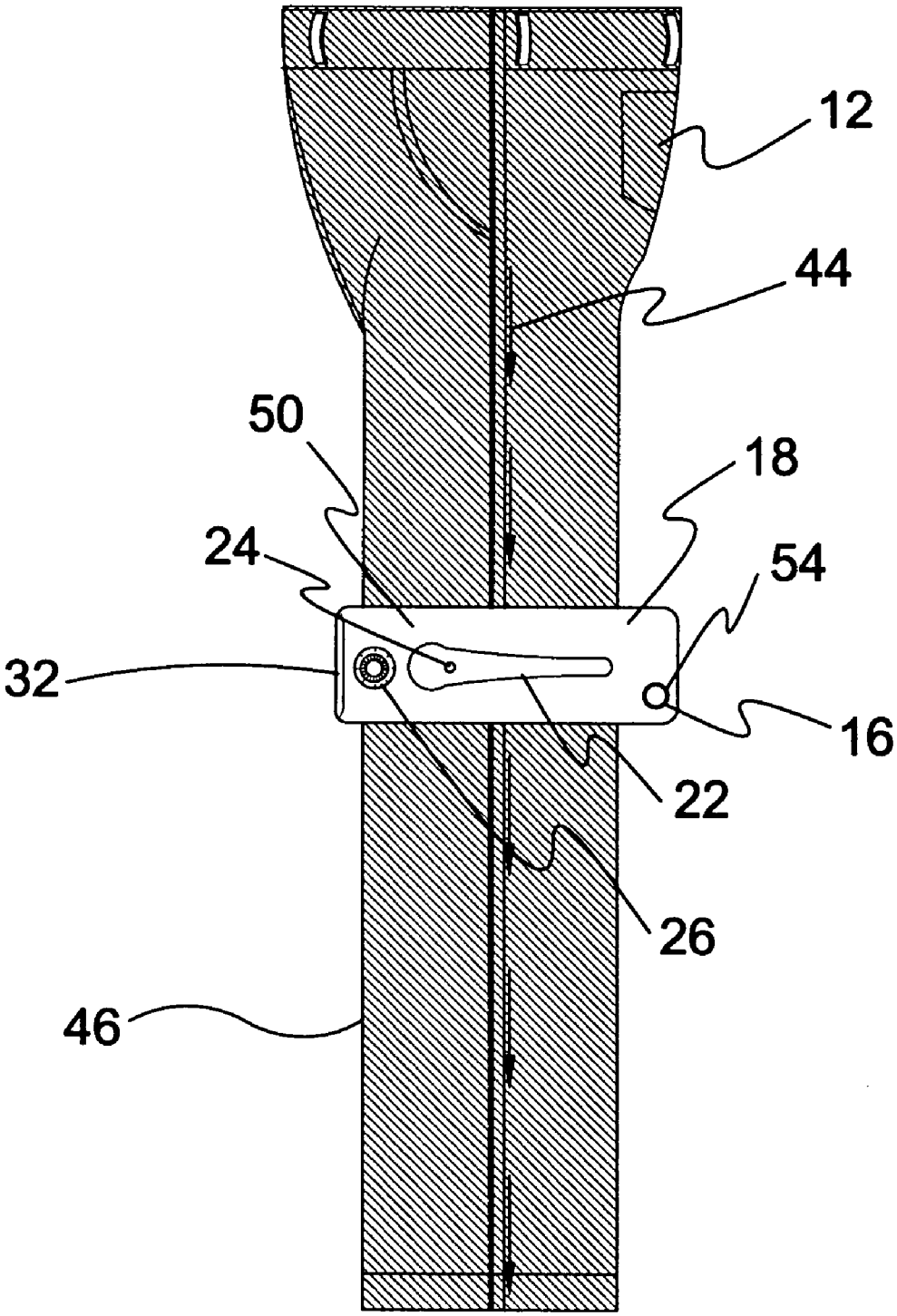
FIG. 4 is an illustrative view of the dual iron device of the present invention in use.

FIG. 4 is an illustrative view of the dual iron device 10 of the present invention. The dual iron device 10 includes the housing 16 having the first member 18 and the second member 20. The first member 18 is attached to the second member 20 via the hinge 38 at one end. The hinge 38 creates a tension such that the first member 18 is parallel to the second member 20. Each member is rectangular in shape.

The first member 18 includes the top side 50 and the bottom side 52. The bottom side includes the first heat plate 28 positioned along the bottom side 52. The second member 20 includes the top side 58 and the bottom side 60 and the bottom side 60 faces the first heat plate 28. The housing 16 includes the heating mechanism 62 for heating the first heat plate 28. The first heat plate 28 includes the plurality of steam ports 32 to release steam onto the fabric 48 when the steam button 24 is depressed. The handle 22 is attached to the top side 50. The length of the handle 22 is centered above the top side 50 in order to maximize the ease of using the device 10. The knuckle pad 36, providing a cushion for the user's knuckles, is located below the handle 22 on the top side 50, as shown in FIG. 2. The heat adjustment knob 26 is located on the top side 50 between the handle 22 and the edge opposing the hinged edge of the top side 50. The heat adjustment knob 26 controls the heating mechanism 62 to determine an amount of heat to apply to the first heat plate 28. The heat for the heat mechanism 62 is supplied by a plurality of means including but not limited to an electrical cord 42 and a battery. Herein the heat is supplied by a battery, not shown.

The steam button 24 is located on the handle 22 and when depressed, is used to steam fabric 48. The open/close clamping trigger 34 is located on the underside of the handle 22. When the open/close clamping trigger 34 is activated, both the first 18 and second 20 members clamp the fabric 48 between them to iron it. However, the clamping is not so tight as to prevent moving the dual iron device 10 along the fabric 48 while the open/close clamping trigger 34 is activated.

Shown herein, the dual iron device 10 is being used to iron the pair of pants 12. The pants 12 are being ironed while hanging, without the use of an ironing board as the bottom 60 of the second member 20 provides a flat and hard surface on which to iron. The pants 12 are placed between the first 18 and second 20 member of the housing 16. The open/close clamping trigger 34 is activated to press the first 18 and second 20 members against the pants 12. The battery is providing the heat to the dual iron device 10. The dual iron device 10 is then moved along the length of the pants 12 in a downward direction as indicated by the downward directional arrows 44 while heat from the first heat plate 28, shown in FIG. 2, presses the pants. The dual iron device 10 creates a crease in the pants 12 due to the way the pants 12 are folded when the dual iron device 10 is applied.

Figure 5:
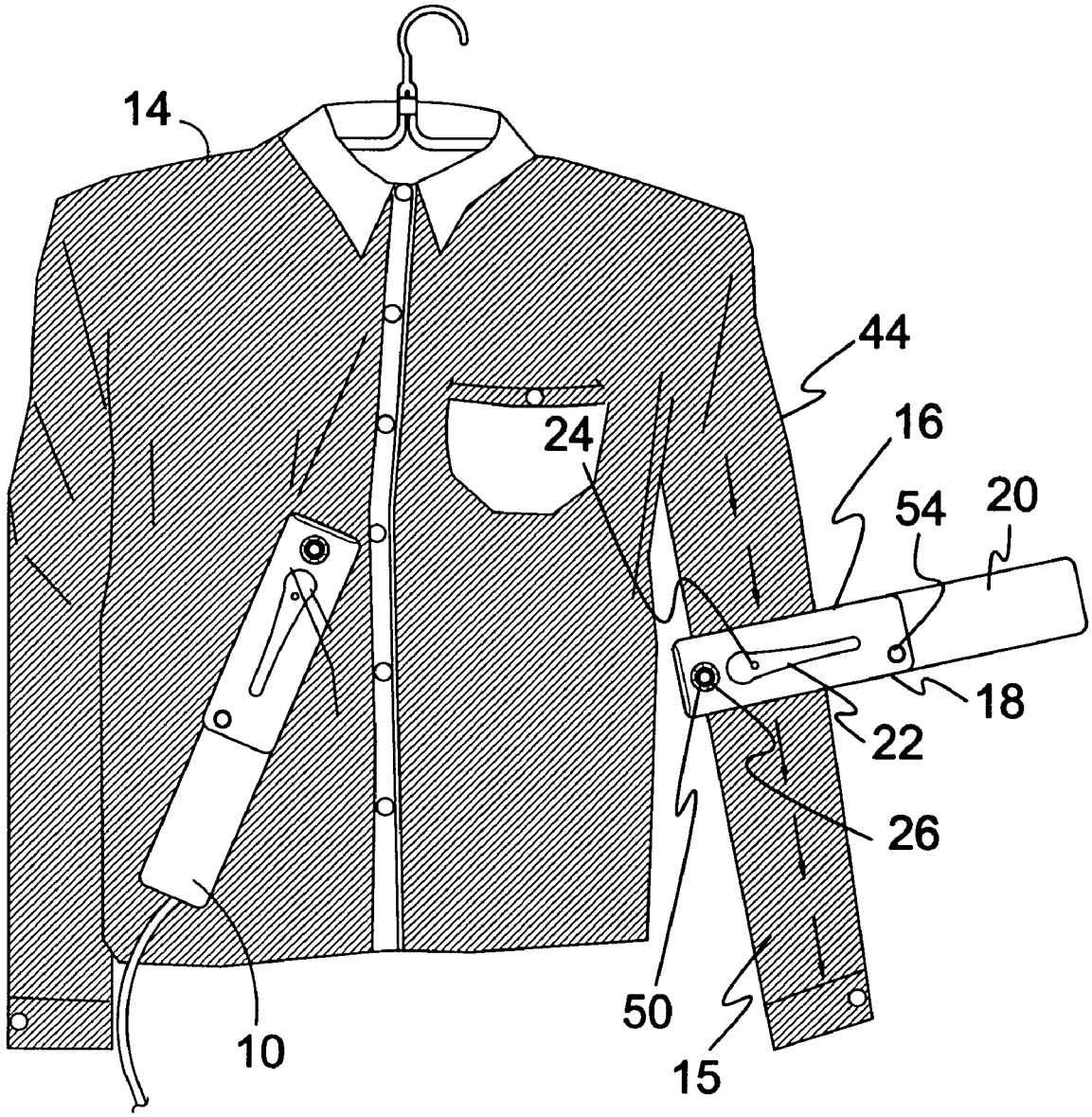
FIG. 5 is an illustrative view of the dual iron device of the present invention in use.

FIG. 5 is an illustrative view of the dual iron device 10 of the present invention. The dual iron device 10 includes the housing 16 having the first member 18 and the second member 20. The first member 18 is attached to the second member 20 via the hinge 38 at one end. The hinge 38 creates a tension such that the first member 18 is parallel to the second member 20. The dual iron device 10 provides for the tension between the first 18 and second 20 members, created by the hinge 38, to be released thereby allowing the first 18 and second 20 members of the housing 16 to be pivoted about the hinge 38 so that they are in the same plane for steaming purposes. Each member is rectangular in shape.

The first member 18 includes the top side 50 and the bottom side 52. The bottom side includes the first heat plate 28 positioned along the bottom side 52. The second member 20 includes the top side 58 and the bottom side 60 and the bottom side 60 faces the first heat plate 28. The housing 16 includes the heating mechanism 62 for heating the first heat plate 28. The first heat plate 28 includes the plurality of steam ports 32 to release steam onto the fabric 48 when the steam button 24 is depressed. The handle 22 is attached to the top side 50. The length of the handle 22 is centered above the top side 50 in order to maximize the ease of using the device 10. The knuckle pad 36, providing a cushion for the user's knuckles, is located below the handle 22 on the top side 50, as shown in FIG. 2. The heat adjustment knob 26 is located on the top side 50 between the handle 22 and the edge opposing the hinged edge of the top side 50. The heat adjustment knob 26 controls the heating mechanism 62 to determine an amount of heat to apply to the first heat plate 28. The heat for the heat mechanism 62 is supplied by a plurality of means including but not limited to an electrical cord 42 and a battery.

The steam button 24 is located on the handle 22 and when depressed, is used to steam fabric 48. The open/close clamping trigger 34 is located on the underside of the handle 22, as shown in FIG. 2. When the open/close clamping trigger 34 is activated, both the first 18 and second 20 members clamp the fabric 48 between them to iron it. However, the clamping is not so tight as to prevent moving the dual iron device 10 along the fabric 48 while the open/close clamping trigger 34 is activated.

The water tank 40 is located within the first member 18 of the housing 16. The water tank 40 is filled with water through the water tank aperture 54 positioned on the top side 50 of the first member 18. A plurality of devices can be used to cover the water tank aperture 54 including but not limited to a cap and a one-way valve. The water is heated by the heating mechanism 62 and when the steam button 24 is depressed, the water is converted to steam and exits the dual iron device 10 through the steam ports 32.

Shown herein, the dual iron device 10 is being used to steam the shirt 14. The dual iron device 10 provides for the tension between the first 18 and second 20 members, created by the hinge 38, to be released thereby allowing the first 18 and second 20 members of the housing 16 to be pivoted about the hinge 38 so that they are in the same plane. The heating mechanism 62 shown herein as an electrical cord 42 heats the water in the water tank 40. When the steam button 24 is depressed, the water is transformed into steam and exits the dual iron device 10 through the steam ports 32 located on the first heat plate 28.

Figure 6:
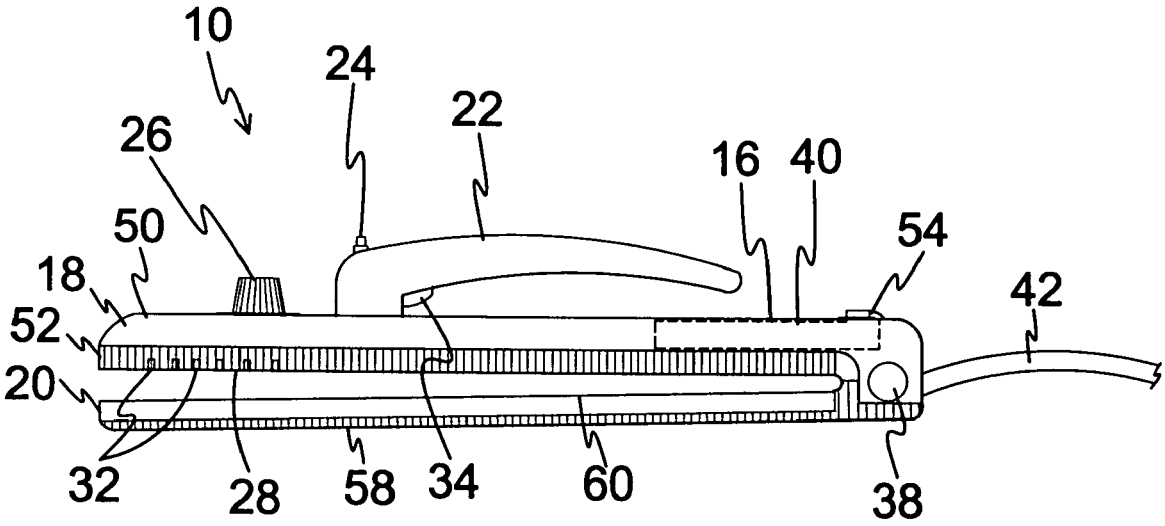
FIG. 6 is a side view of the dual iron device of the present invention in an open position.

FIG. 6 is a side view of the dual iron device 10 of the present invention in an unclamped or "open" position. The dual iron device 10 includes the housing 16 having the first member 18 and the second member 20. The first member 18 is attached to the second member 20 via the hinge 38 at one end. The hinge 38 creates a tension such that the first member 18 is parallel to the second member 20. Each member is rectangular in shape.

The first member 18 includes the top side 50 and the bottom side 52. The bottom side includes the first heat plate 28 positioned along the bottom side 52. The second member 20 includes the top side 58 and the bottom side 60 and the bottom side 60 faces the first heat plate 28. The housing 16 includes the heating mechanism 62 for heating the first heat plate 28. The first heat plate 28 includes the plurality of steam ports 32 to release steam onto the fabric 48 when the steam button 24 is depressed. The handle 22 is attached to the top side 50. The length of the handle 22 is centered above the top side 50 in order to maximize the ease of using the device 10. The knuckle pad 36, providing a cushion for the user's knuckles, is located below the handle 22 on the top side 50, as shown in FIG. 2. The heat adjustment knob 26 is located on the top side 50 between the handle 22 and the edge opposing the hinged edge of the top side 50. The heat adjustment knob 26 controls the heating mechanism 62 to determine an amount of heat to apply to the first heat plate 28. The heat for the heat mechanism 62 is supplied by a plurality of means including but not limited to an electrical cord 42 and a battery.

The handle 22 includes the steam button 24 located thereon for steaming fabric 48 when depressed. The underside of the handle 22 includes the open/close clamping trigger 34. When the open/close clamping trigger 34 is activated, both the first 18 and second 20 members clamp the fabric 48 between them to iron it. However, the clamping is not so tight as to prevent moving the dual iron device 10 along the fabric 48 while the open/close clamping trigger 34 is activated.

The water tank 40 is located within the first member 18 of the housing 16. The water tank 40 is filled with water through the water tank aperture 54 positioned on the top side 50 of the first member 18. A plurality of devices can be used to cover the water tank aperture 54 including but not limited to a cap and a one-way valve. The water is heated by the heating mechanism 62 and when the steam button 24 is depressed, the water is converted to steam and exits the dual iron device 10 through the steam ports 32.

Shown herein, the open/close clamping trigger 34 is not activated. Thus, the first 18 and second 20 members of the housing 16 are in the "open" position. In the "open" position, it is easier to place fabric 48 between the first 18 and second members 20. Additionally, when in the "open" position, the dual iron device 10 does not create a sharp crease when applied to the fabric 48.

Figure 7:
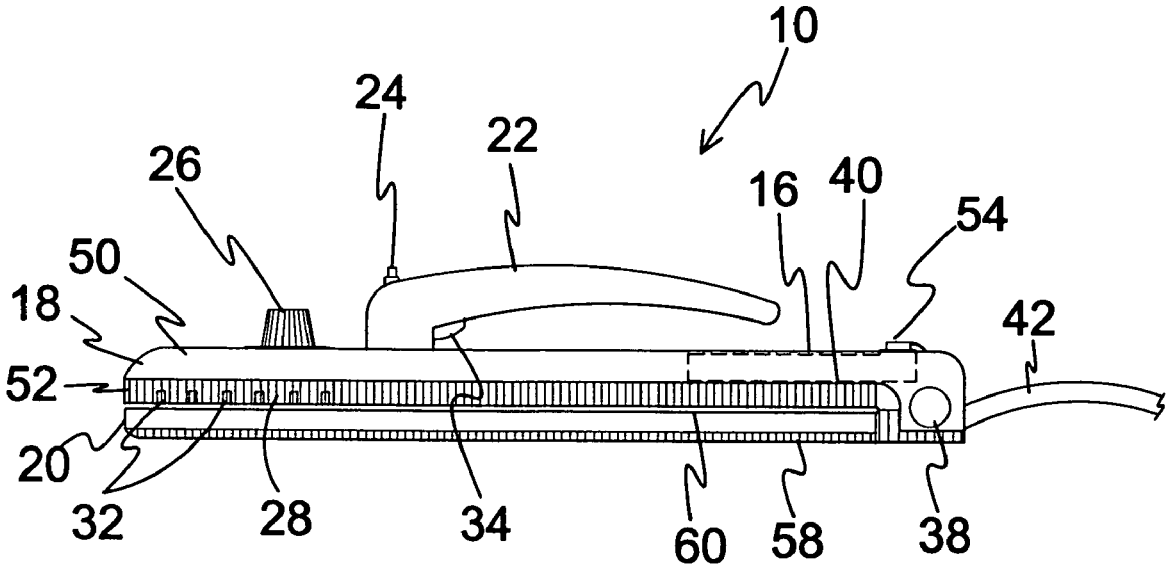
FIG. 7 is a side view of the dual iron device of the present invention in a closed position.

FIG. 7 is a side view of the dual iron device 10 of the present invention in a clamped or "closed" position. The dual iron device 10 includes the housing 16 having the first member 18 and the second member 20. The first member 18 is attached to the second member 20 via the hinge 38 at one end. The hinge 38 creates a tension such that the first member 18 is parallel to the second member 20. Each member is rectangular in shape.

The first member 18 includes the top side 50 and the bottom side 52. The bottom side includes the first heat plate 28 positioned along the bottom side 52. The second member 20 includes the top side 58 and the bottom side 60 and the bottom side 60 faces the first heat plate 28. The housing 16 includes the heating mechanism 62 for heating the first heat plate 28. The first heat plate 28 includes the plurality of steam ports 32 to release steam onto the fabric 48 when the steam button 24 is depressed. The handle 22 is attached to the top side 50. The length of the handle 22 is centered above the top side 50 in order to maximize the ease of using the device 10. The knuckle pad 36, providing a cushion for the user's knuckles, is located below the handle 22 on the top side 50, as shown in FIG. 2. The heat adjustment knob 26 is located on the top side 50 between the handle 22 and the edge opposing the hinged edge of the top side 50. The heat adjustment knob 26 controls the heating mechanism 62 to determine an amount of heat to apply to the first heat plate 28. The heat for the heat mechanism 62 is supplied by a plurality of means including but not limited to an electrical cord 42 and a battery.

The second member 20 of the housing 16 includes the top 58 and the bottom 60. The bottom 60 of the second member 20 is a hard flat surface which acts as an ironing board. The top 58 of the second member 20 is made of a heat resistant material to prevent burning the user.

The handle 22 includes the steam button 24 located thereon for steaming fabric 48 when depressed. The underside of the handle 22 includes the open/close clamping trigger 34. When the open/close clamping trigger 34 is activated, both the first 18 and second 20 members clamp the fabric 48 between them to iron it. However, the clamping is not so tight as to prevent moving the dual iron device 10 along the fabric 48 while the open/close clamping trigger 34 is activated.

The water tank 40 is located within the first member 18 of the housing 16. The water tank 40 is filled with water through the water tank aperture 54 positioned on the top side 50 of the first member 18. A plurality of devices can be used to cover the water tank aperture 54 including but not limited to a cap and a one-way valve. The water is heated by the heating mechanism 62 and when the steam button 24 is depressed, the water is converted to steam and exits the dual iron device 10 through the steam ports 32.

Shown herein, the open/close clamping trigger 34 is activated. Thus, the first 18 and second 20 members of the housing 16 are in the "closed" position. In the "closed" position, the fabric 48 is held firmly between the first 18 and second member 20. However, the "closed" position still permits the dual iron device 10 is still able to move along the fabric 48. Additionally, when in the "closed" position, the dual iron device 10 creates a sharp crease when applied to the fabric 48 if desired.

Figure 8:
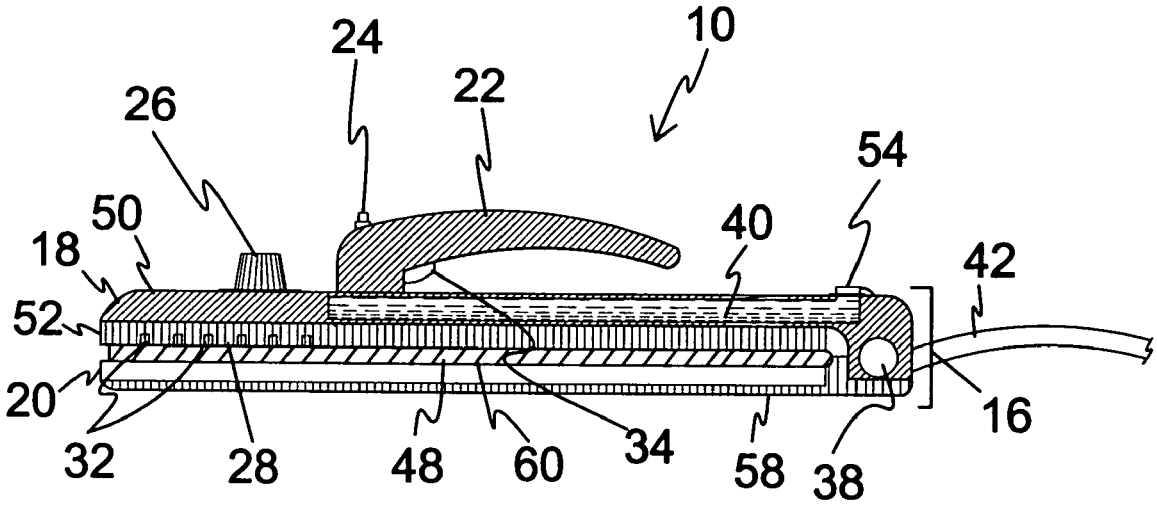
FIG. 8 is a sectional view of the dual iron device of the present invention.

FIG. 8 is a sectional view of the dual iron device 10 of the present invention. The dual iron device 10 includes the housing 16 having the first member 18 and the second member 20. The first member 18 is attached to the second member 20 via the hinge 38 at one end. The hinge 38 creates a tension such that the first member 18 is parallel to the second member 20. Each member is rectangular in shape.

The first member 18 includes the top side 50 and the bottom side 52. The bottom side includes the first heat plate 28 positioned along the bottom side 52. The second member 20 includes the top side 58 and the bottom side 60 and the bottom side 60 faces the first heat plate 28. The housing 16 includes the heating mechanism 62 for heating the first heat plate 28. The first heat plate 28 includes the plurality of steam ports 32 to release steam onto the fabric 48 when the steam button 24 is depressed. The handle 22 is attached to the top side 50. The length of the handle 22 is centered above the top side 50 in order to maximize the ease of using the device 10. The knuckle pad 36, providing a cushion for the user's knuckles, is located below the handle 22 on the top side 50, as shown in FIG. 2. The heat adjustment knob 26 is located on the top side 50 between the handle 22 and the edge opposing the hinged edge of the top side 50. The heat adjustment knob 26 controls the heating mechanism 62 to determine an amount of heat to apply to the first heat plate 28. The heat for the heat mechanism 62 is supplied by a plurality of means including but not limited to an electrical cord 42 and a battery.

When the first member 18 is parallel to the second member 20 of the housing 16, the bottom 60 of the second member 20 is located between the bottom side 52 of the first member 18 and the top side 58 of the second member 20. The bottom 60 of the second member 20 is a hard flat surface that acts as an ironing board. In an alternative embodiment, the bottom 60 of the second member 20 is covered with the second heat plate 30. In this alternate embodiment, both sides of the fabric 48 are ironed simultaneously thereby decreasing the ironing time. The top 58 of the second member 20 is made of a heat resistant material to prevent burning the user.

The handle 22 includes the steam button 24 located thereon for steaming fabric 48 when depressed. The underside of the handle 22 includes the open/close clamping trigger 34. When the open/close clamping trigger 34 is activated, both the first 18 and second 20 members clamp the fabric 48 between them to iron it. However, the clamping is not so tight as to prevent moving the dual iron device 10 along the fabric 48 while the open/close clamping trigger 34 is activated.

The water tank 40 is located within the first member 18 of the housing 16. The water tank 40 is filled with water through the water tank aperture 54 positioned on the top side 50 of the first member 18. A plurality of devices can be used to cover the water tank aperture 54 including but not limited to a cap and a one-way valve. The water is heated by the heating mechanism 62 and when the steam button 24 is depressed, the water is converted to steam and exits the dual iron device 10 through the steam ports 32.

Figure 9:
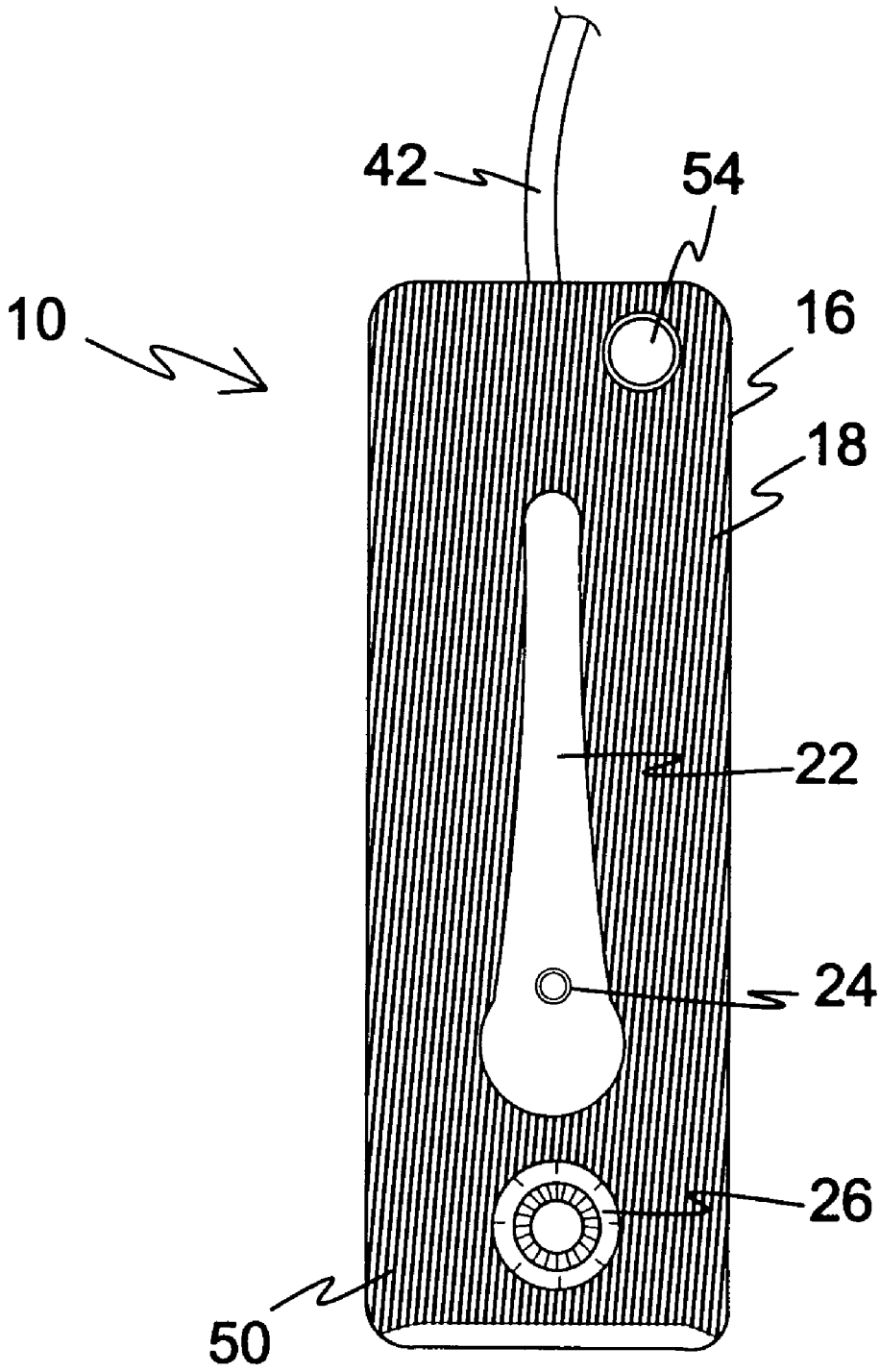
FIG. 9 is a top view of the dual iron device of the present invention.

FIG. 9 is a top view of the dual iron device 10 of the present invention. The dual iron device 10 includes the housing 16 having the first member 18 and the second member 20. The first member 18 is attached to the second member 20 via the hinge 38 at one end. The hinge 38 creates a tension such that the first member 18 is parallel to the second member 20. Each member is rectangular in shape.

The first member 18 includes the top side 50 and the bottom side 52. The bottom side includes the first heat plate 28 positioned along the bottom side 52. The second member 20 includes the top side 58 and the bottom side 60 and the bottom side 60 faces the first heat plate 28. The housing 16 includes the heating mechanism 62 for heating the first heat plate 28. The first heat plate 28 includes the plurality of steam ports 32 to release steam onto the fabric 48 when the steam button 24 is depressed. The handle 22 is attached to the top side 50. The length of the handle 22 is centered above the top side 50 in order to maximize the ease of using the device 10. The knuckle pad 36, providing a cushion for the user's knuckles, is located below the handle 22 on the top side 50, as shown in FIG. 2. The heat adjustment knob 26 is located on the top side 50 between the handle 22 and the edge opposing the hinged edge of the top side 50. The heat adjustment knob 26 controls the heating mechanism 62 to determine an amount of heat to apply to the first heat plate 28. The heat for the heat mechanism 62 is supplied by a plurality of means including but not limited to an electrical cord 42 and a battery.

The handle 22 includes the steam button 24 located thereon for steaming fabric 48 when depressed. The underside of the handle 22 includes the open/close clamping trigger 34, shown in FIG. 2. When the open/close clamping trigger 34 is activated, both the first 18 and second 20 members clamp the fabric 48 between them to iron it. However, the clamping is not so tight as to prevent moving the dual iron device 10 along the fabric 48 while the open/close clamping trigger 34 is activated.

Figure 10:
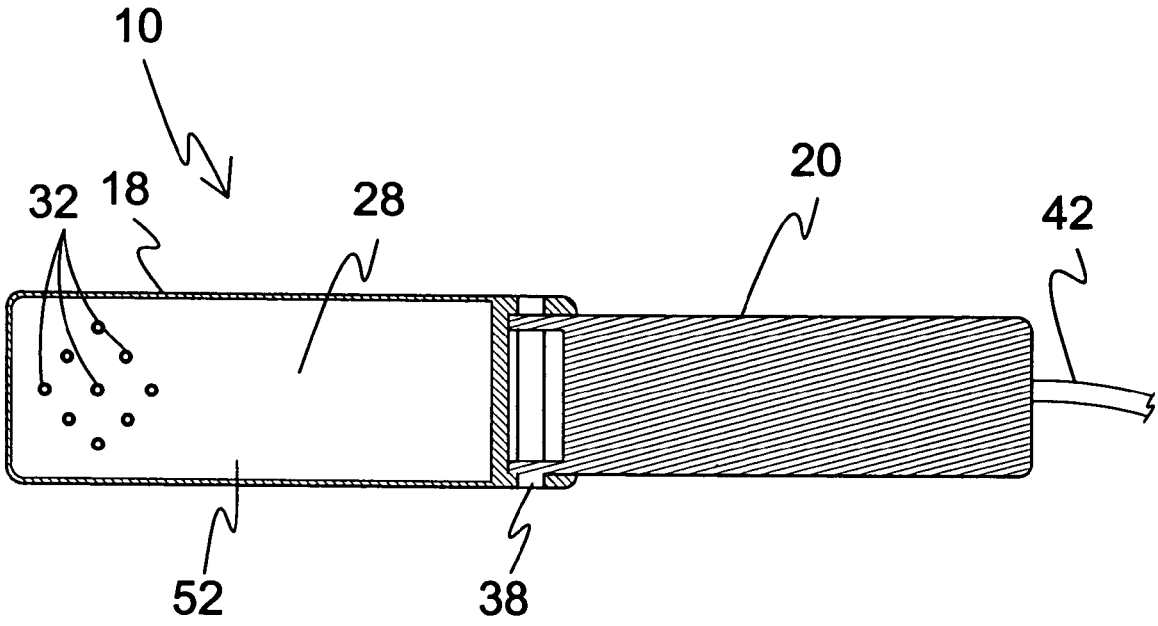
FIG. 10 is an under side view of the dual iron device of the present invention in a fully open position.

FIG. 10 is a perspective view of the dual iron device 10 of the present invention in the steaming position. The dual iron device 10 includes the housing 16 having the first member 18 and the second member 20. The first member 18 is attached to the second member 20 via the hinge 38 at one end. The hinge 38 creates a tension such that the first member 18 is parallel to the second member 20. The dual iron device 10 provides for the tension between the first 18 and second 20 members, created by the hinge 38, to be released thereby allowing the first 18 and second 20 members of the housing 16 to be pivoted about the hinge 38 so that they are in the same plane for steaming purposes. Each member is rectangular in shape.

The first member 18 includes the top side 50 and the bottom side 52. The bottom side includes the first heat plate 28 positioned along the bottom side 52. The second member 20 includes the top side 58 and the bottom side 60 and the bottom side 60 faces the first heat plate 28. The housing 16 includes the heating mechanism 62 for heating the first heat plate 28. The first heat plate 28 includes the plurality of steam ports 32 to release steam onto the fabric 48 when the steam button 24 is depressed. The heat adjustment knob 26 is located on the top side 50 between the handle 22 and the edge opposing the hinged edge of the top side 50. The heat adjustment knob 26 controls the heating mechanism 62 to determine an amount of heat to apply to the first heat plate 28. The heat for the heat mechanism 62 is supplied by a plurality of means including but not limited to an electrical cord 42 and a battery.

The water tank 40 is located within the first member 18 of the housing 16. The water tank 40 is filled with water through the water tank aperture 54 positioned on the top side 50 of the first member 18. A plurality of devices can be used to cover the water tank aperture 54 including but not limited to a cap and a one-way valve. The water is heated by the heating mechanism 62 and when the steam button 24 is depressed, the water is converted to steam and exits the dual iron device 10 through the steam ports 32.

Figure 11:
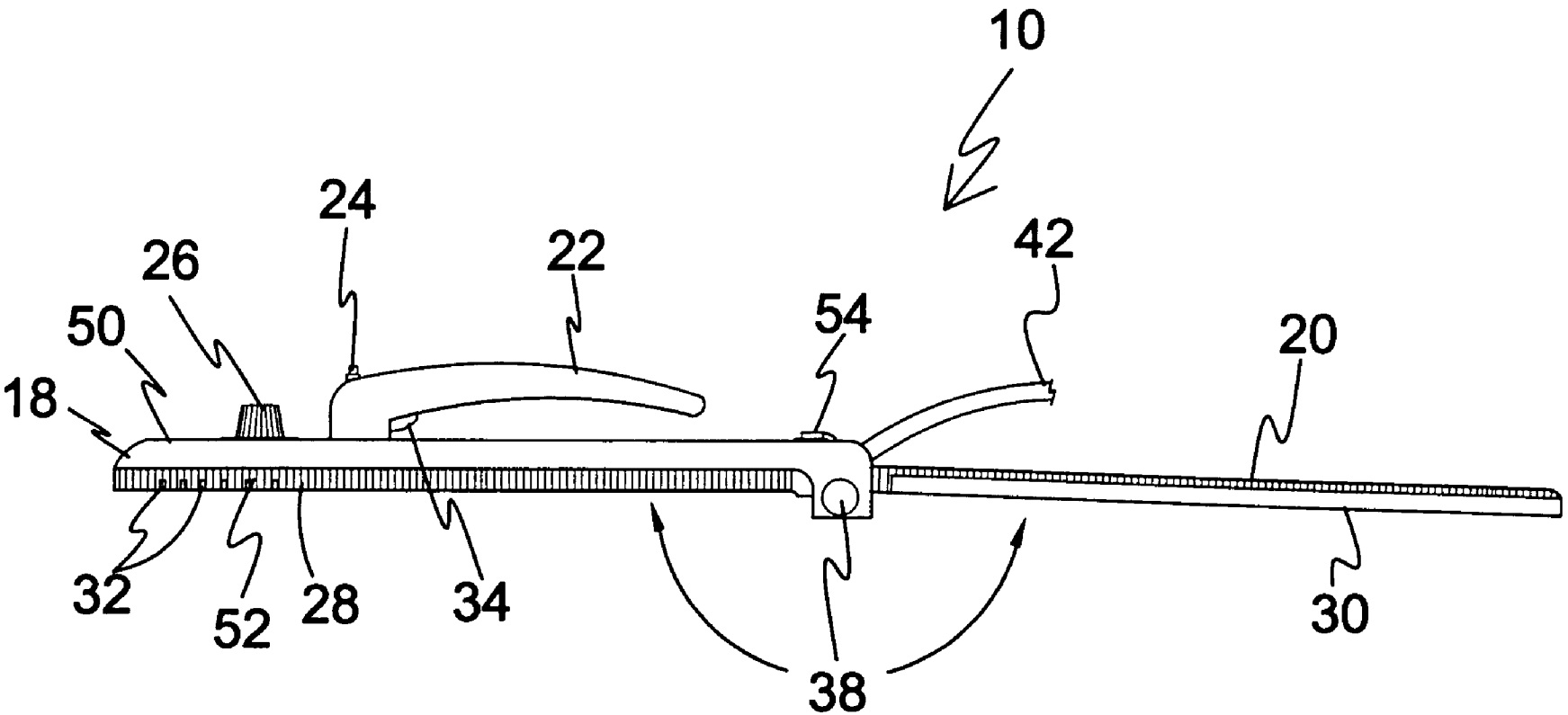
FIG. 11 is a side view of the dual iron device of the present invention in a fully open position.

FIG. 11 is a side view of the dual iron device 10 of the present invention in the steaming position. The dual iron device 10 includes the housing 16 having the first member 18 and the second member 20. The first member 18 is attached to the second member 20 via the hinge 38 at one end. The hinge 38 creates a tension such that the first member 18 is parallel to the second member 20. The dual iron device 10 provides for the tension between the first 18 and second 20 members, created by the hinge 38, to be released thereby allowing the first 18 and second 20 members of the housing 16 to be pivoted about the hinge 38 so that they are in the same plane for steaming purposes. Each member is rectangular in shape.

The first member 18 includes the top side 50 and the bottom side 52. The bottom side includes the first heat plate 28 positioned along the bottom side 52. The second member 20 includes the top side 58 and the bottom side 60 and the bottom side 60 faces the first heat plate 28. The housing 16 includes the heating mechanism 62 for heating the first heat plate 28. The first heat plate 28 includes the plurality of steam ports 32 to release steam onto the fabric 48 when the steam button 24 is depressed. The handle 22 is attached to the top side 50. The length of the handle 22 is centered above the top side 50 in order to maximize the ease of using the device 10. The knuckle pad 36, providing a cushion for the user's knuckles, is located below the handle 22 on the top side 50, as shown in FIG. 2. The heat adjustment knob 26 is located on the top side 50 between the handle 22 and the edge opposing the hinged edge of the top side 50. The heat adjustment knob 26 controls the heating mechanism 62 to determine an amount of heat to apply to the first heat plate 28. The heat for the heat mechanism 62 is supplied by a plurality of means including but not limited to an electrical cord 42 and a battery.

The steam button 24 is located on the handle 22 and when depressed, is used to steam fabric 48. The open/close clamping trigger 34 is located on the underside of the handle 22. When the open/close clamping trigger 34 is activated, both the first 18 and second 20 members clamp the fabric 48 between them to iron it. However, the clamping is not so tight as to prevent moving the dual iron device 10 along the fabric 48 while the open/close clamping trigger 34 is activated.

The water tank 40 is located within the first member 18 of the housing 16. The water tank 40 is filled with water through the water tank aperture 54 positioned on the top side 50 of the first member 18. A plurality of devices can be used to cover the water tank aperture 54 including but not limited to a cap and a one-way valve. The water is heated by the heating mechanism 62 and when the steam button 24 is depressed, the water is converted to steam and exits the dual iron device 10 through the steam ports 32.

It will be understood that each of the elements described above, or two or more together may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An apparatus for changing a characteristic of fabric comprising:

a) a rectangular first member;

b) a rectangular second member, narrow ends of said first and second members having a hinge for pivotally connected said members to each other, with bottom sides of said first and second members facing each other when said members are pivoted toward each other;

c) a heating plate mounted on the bottom side of said first member for providing heat to a fabric positioned between said first and second members;

d) a heating device within said first member for heating said heating plate;

e) means connected to said heating device for generating steam, said heating plate having steam openings to deliver steam to said fabric, said steam openings being located adjacent a free end of said first member;

f) a water tank positioned in said first member connected to said steaming means for providing water to be used in generating said steam, said water tank having a filler opening adjacent said hinge;

g) said hinge being tension hinge which provides a predetermining amount of tension and a predetermined distance between said first and second members when said members are in a folded position facing each other thereby allowing for movement of said apparatus along said fabric;

h) a handle mounted on a top side of said first member, said handle being elongated and having one end attached to said top side of said first member and a free end thereof extending toward said hinge;

i) a heat adjustment knob mounted on said top side of said first member located between said handle and an end of said first member opposite to said hinge;

j) a steam button mounted on said handle on said first end thereof for releasing steam through said stream openings;

k) an open/close clamping trigger mounted on an underside of said handle adjacent the first end thereof for clamping said members in a folded position facing each other with a space therebetween to allow movement of said fabric between said members; and l) said members having sufficient length to completely enclose a pants leg or a sleeve to allow creases to be produced simultaneously at both sides of said pants leg or sleeve.

2. The apparatus as recited in claim 1, further comprising a clamping device connected to said tension hinge for reducing said predetermined distance between said first and said second members for contacting said fabric therebetween.

3. The apparatus as recited in claim 2, further comprising a tension release connected to said tension hinge wherein said first member is pivotable thereabout resulting in said first member and said second member being in the same plane and having an angle of 180 degrees between said first and second members.

4. The apparatus as recited in claim 3, further comprising a rechargeable power source connected to said heating device for providing power thereto.

5. The apparatus as recited in claim 4, wherein said apparatus is portable.

* * * * *